US010395876B1

(12) United States Patent
Su et al.

(10) Patent No.: US 10,395,876 B1
(45) Date of Patent: Aug. 27, 2019

(54) PROTECTION DEVICE

(71) Applicant: Polytronics Technology Corp., Hsinchu (TW)

(72) Inventors: Tsung Min Su, Hsinchu (TW); Chia Mao Chen, Ji'an Township, Hualien County (TW); David Shau Chew Wang, Taipei (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 0 days.

(21) Appl. No.: 16/290,317

(22) Filed: Mar. 1, 2019

(30) Foreign Application Priority Data

Jul. 31, 2018 (TW) ..... 107126571 A

(51) Int. Cl.

| | |
|---|---|
| ***H01H 85/00*** | (2006.01) |
| ***H01H 69/02*** | (2006.01) |
| ***H01H 85/20*** | (2006.01) |
| ***H01H 85/04*** | (2006.01) |
| *H01H 85/041* | (2006.01) |

(52) U.S. Cl.
CPC ..... *H01H 85/0052* (2013.01); *H01H 69/02* (2013.01); *H01H 85/04* (2013.01); *H01H 85/20* (2013.01); *H01H 85/0047* (2013.01); *H01H 2085/0414* (2013.01)

(58) Field of Classification Search
CPC ..... H01H 69/02; H01H 85/0047; H01H 85/0052; H01H 85/04; H01H 85/20; H01H 2085/0414
USPC ..... 337/183
See application file for complete search history.

(56) References Cited

U.S. PATENT DOCUMENTS

| | | | | |
|---|---|---|---|---|
| 6,269,745 | B1 * | 8/2001 | Cieplik | H01H 85/046 102/202.5 |
| 6,566,995 | B2 * | 5/2003 | Furuuchi | H01L 23/5256 257/E23.149 |
| 2008/0100411 | A1 * | 5/2008 | Tofigh | H01H 85/0047 337/163 |
| 2015/0249332 | A1 * | 9/2015 | Kang | H02H 9/044 361/91.1 |
| 2015/0249333 | A1 * | 9/2015 | Kang | H02H 9/02 361/91.1 |
| 2015/0303011 | A1 * | 10/2015 | Jung | H02H 7/18 337/414 |
| 2015/0303012 | A1 * | 10/2015 | Jung | H02H 7/18 337/414 |

* cited by examiner

*Primary Examiner* — Jacob R Crum
(74) *Attorney, Agent, or Firm* — Muncy, Geissler, Olds & Lowe, P.C.

(57) ABSTRACT

A protection device comprises a first planar substrate, a second planar substrate, a heater and a fusible element. The first planar substrate comprises a first surface, and the second planar substrate comprises a second surface facing the first surface. The heater comprises a first heating element and a second heating element in parallel connection, and the first heating element is disposed on the first surface. The fusible element is disposed on the first surface and adjacent to the first and second heating elements, thereby the fusible element is melted by absorbing the heat generated by the first heating element and/or second heating element. The second heating element has a resistance at least twice that of the first heating element.

10 Claims, 10 Drawing Sheets

PROTECTION DEVICE

BACKGROUND OF THE INVENTION

(1) Field of the Invention

The present application relates to a protection device. More specifically, it relates to a protection device capable of preventing over-voltage, over-current and/or over-temperature.

(2) Description of the Related Art

Fuses containing low-melting metals, e.g., lead, tin or antimony, are well-known protection devices to cut off currents. To prevent over-current and over-voltage, various protection devices are continuously developed. For example, a device containing a substrate on which a heating layer and a low-melting metal layer are stacked in sequence. The heating layer heats up in the event of over-voltage, and then the heat is transferred upwards to the low-melting metal layer. As a result, the low-melting metal layer is melted and blown to sever currents flowing therethrough, so as to protect circuits or electronic apparatuses.

Recently, mobile apparatuses such as cellular phones and laptop computers are widely used, and people increasingly rely on such products over time. However, burnout or explosion of batteries of cellular phones or portable products during charging or discharging is often seen. Therefore, the manufacturers continuously improve the designs of over-current and over-voltage protection devices to prevent the batteries from being blown due to over-current or over-voltage during charging or discharging.

In a known protection device, the low-melting metal layer is in series connection to a power line of a battery, and the low-melting metal layer and a heating layer are electrically coupled to a switch and an integrated circuit (IC) device. When the IC device detects an over-voltage event, the IC device enables the switch to "on". As a result, current flows through the heating layer to generate heat to melt and blow the low-melting metal layer, so as to sever the power line to the battery for over-voltage protection. Moreover, it can be easily understood that the low-melting metal layer, e.g., fuses, can be heated and blown by a large amount of current in the event of over-current, and therefore over-current protection can be achieved also.

FIG. 1 shows a known cross-sectional view of a protection device implementing the above-mentioned protection mechanism. A protection device 100 comprises a substrate 110, a heating element 120, an insulating layer 130, a low-melting metal layer 140, a flux 150 and a housing 170. The housing 170 is placed on the substrate 110 and has an internal space to receive the heating element 120, the insulating layer 130, the low-melting metal layer 140 and the flux 150. The heating element 120 is disposed on the substrate 110 and electrically connects to two heating element electrodes 125. The low-melting metal layer 140 connects to electrodes 160 at two sides and an intermediate electrode 165 in the middle. The insulating layer 130 covers the heating element 120 and the heating element electrodes 125. The low-melting metal layer 140 is disposed above the insulating layer 130 to be a fuse and is overlaid by the flux 150. As a result, the heating element 120 heats up to melt the low-melting metal layer 140, and then the low-melting metal layer 140 flows to the two electrodes 160 and the intermediate electrode 165. More specifically, the two electrodes 160 and the intermediate electrode 165 accumulate the melted metal of the low-melting metal layer 140, resulting in that the low-melting metal layer 140 is divided into three pieces to cut off the current flowing through it for protection.

To obtain a short blowing time of the low-melting metal layer 140 of the protection device 100, the heating element 120 may use a large heating power and have a low resistance to acquire a large current. However, the heating element 120 of a certain resistance has a corresponding adequate endurable voltage. The heating element 120 of a low resistance has a low endurable voltage and may be blown if undergoing a high voltage. It is desirable to increase voltage endurance and enlarge voltage application range of the protection device.

SUMMARY OF THE INVENTION

The present application provides a protection device for over-current, over-voltage and/or over-temperature protection. The protection device comprises at least two heating elements of different resistances. To adapt to an applying voltage, either one of the heating elements can be automatically activated to heat the fusible element, thereby increasing the voltage endurance and enlarging voltage application range.

In accordance with an embodiment of the present application, a protection device comprises a first planar substrate, a second planar substrate, a heater and a fusible element. The first planar substrate comprises a first surface, and the second planar substrate comprises a second surface facing the first surface. The heater comprises a first heating element and a second heating element connected in parallel. The first heating element is disposed on the first surface. The fusible element is disposed on the first surface and is adjacent to the first heating element and the second heating element to absorb the heat generated by at least one of the first and second heating elements and thereby be melted. The resistance of the second heating element is at least twice that of the first heating element.

In an embodiment, the first heating element is blown and a current flowing therethrough is cut off when a voltage applied to the protection device exceeds a predetermined voltage.

In an embodiment, when the voltage is smaller than the predetermined voltage, the first heating element heats up to heat the fusible element. When the voltage is larger than the predetermined voltage, the second heating element heats up to heat the fusible element.

In an embodiment, the second heating element is disposed on the second surface and the fusible element is disposed between the first heating element and the second heating element.

In an embodiment, the fusible element has two ends connecting to a first electrode and a second electrode. The first heating element has two ends connecting to a third electrode and a fourth electrode. The second heating element has two ends connecting to a fifth electrode and a six electrode.

In an embodiment, the third electrode and the fifth electrode are electrically coupled through conductive posts, and the fourth electrode and the sixth electrode are electrically coupled through other conductive posts.

In an embodiment, the fusible element has two ends connecting to a first terminal and a second terminal, and the middle of the fusible element connects to a central electrode. The heater has two ends connecting to the central electrode and a third terminal.

In an embodiment, an absorbent element is disposed above the middle of the fusible element to absorb molten fusible element.

In an embodiment, the first heating element is printed on the first surface, and the second heating element is printed on the second surface.

In an embodiment, the protection device further comprises a third heating element in parallel connection to the first and second heating elements.

In an embodiment, the third heating element and the first heating element are formed on a same plane.

In an embodiment, the resistance of the second heating element does not exceed 12 times the resistance of the first heating element.

In the protection device of the present application, the resistance of the second heating element is at least twice that of the first heating element. For a low voltage, most of current flows through the first heating element of a low resistance and the first heating element heats up to heat the fusible element. When the voltage exceeds a predetermined voltage, the first heating element cannot withstand it and therefore is blown to cut off the current flowing therethrough. The current is switched to the second heating element in parallel connection with the first heating element, and then the second heating element heats up to blow the fusible element. The second heating element of a larger resistance can withstand a higher voltage in comparison with the first heating element. According to different applying voltages, the protection device can automatically select the first or second heating element to heat and blow the fusible element. It is advantageous to increase voltage endurance and enlarge voltage application range of the protection device.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
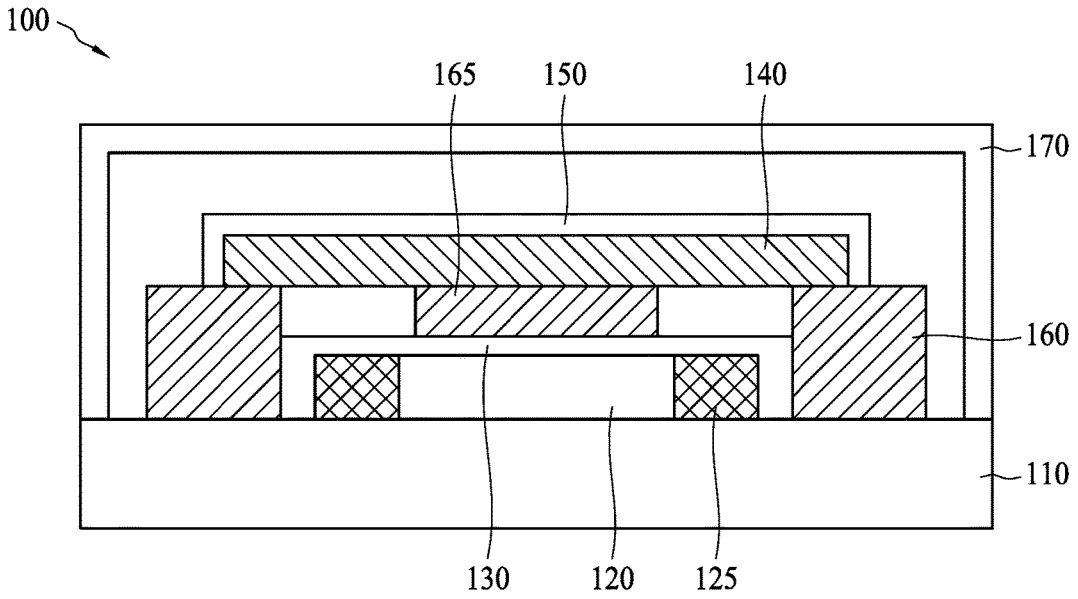
FIG. 1 (Prior Art)
FIG. 1 shows a known protection device.
Figure 2:
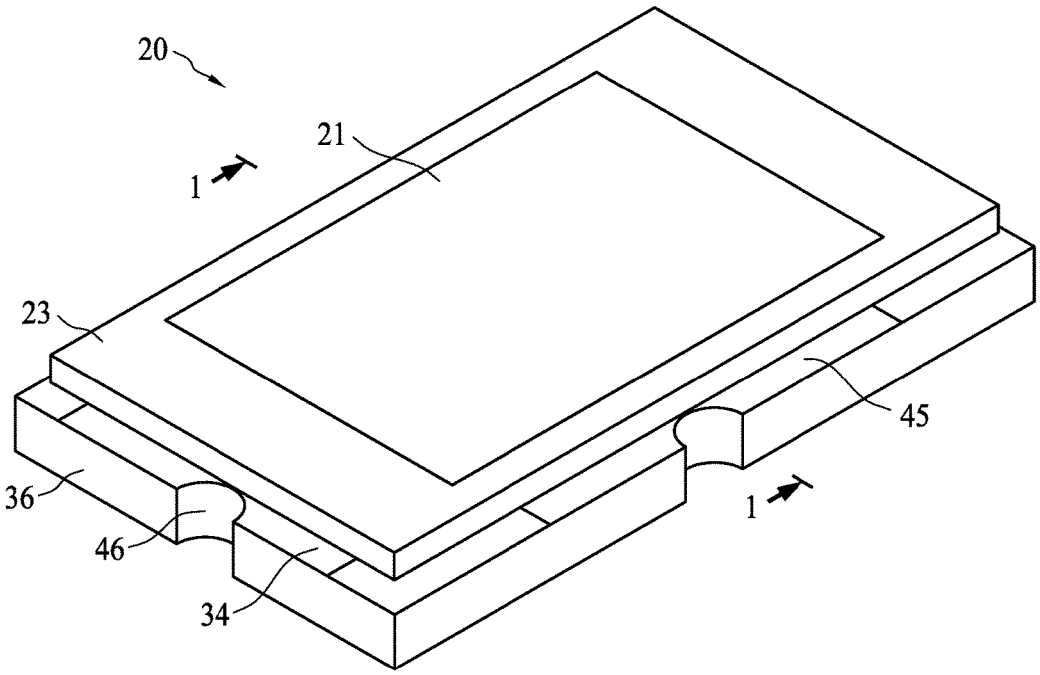
FIG. 2 shows a protection device in accordance with an embodiment of the present application.
Figure 3:
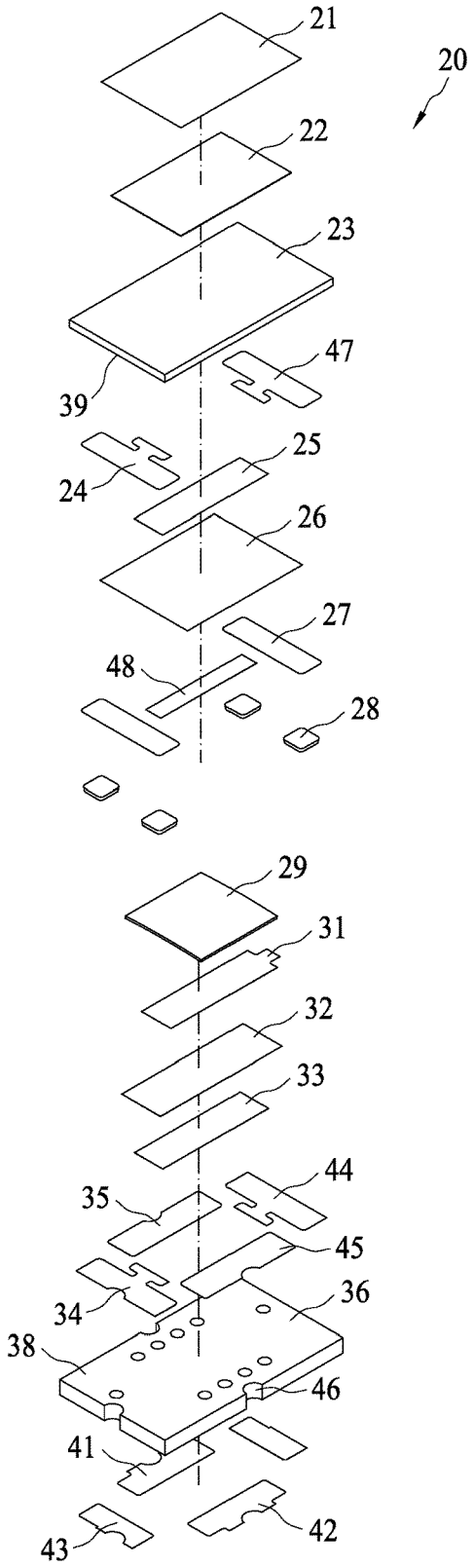
FIG. 3 shows an exploded view of the protection device in accordance with an embodiment of the present application.
Figure 4:
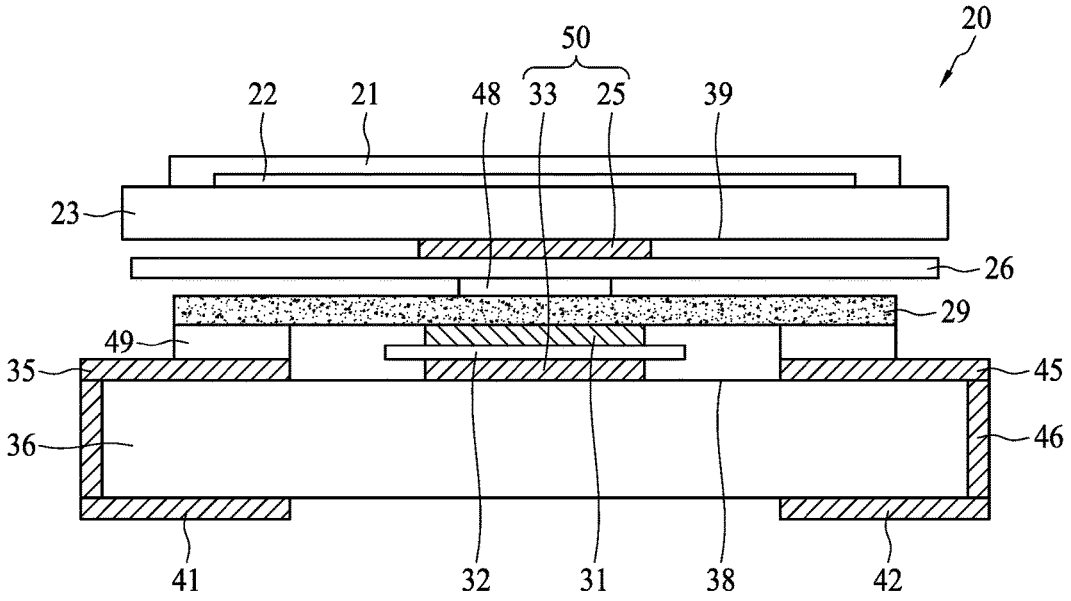
FIG. 4 shows a cross-sectional view of the protection device along line 1-1 of FIG. 2.

FIG. 2 shows a protection device 20 in accordance with an embodiment of the present application. FIG. 3 shows an exploded view of the protection device 20. FIG. 4 shows a cross-sectional view of the protection device 20 along line 1-1 in FIG. 2. The protection device 20 essentially comprises a first planar substrate 36, a second planar substrate 23, a first heating element 33, a second heating element 25 and a fusible element 29. An upper surface of the first planar surface 36 is a first surface 38 on which a first electrode 35, a second electrode 45, a third electrode 34 and a fourth electrode 44 are formed by, for example, printing. The first electrode 35, the second electrode 45 and the third electrode 34 electrically connect to a first terminal 41, a second terminal 42 and a third terminal 43 on the bottom of the first planar substrate 36, respectively, through conductive holes 46 on sidewalls of the first planar substrate 36. The first terminal 41, the second terminal 42 and the third terminal 43 serve as interfaces for connecting to outer circuits. A first heating element 33 may be formed by printing. The first heating element 33 may be of a strip shape with two ends connecting to the third electrode 34 and the fourth electrode 44. The fusible element 29 spans and connects to the first electrode 35 and the second electrode 45 through solders 49 at two ends. A central electrode 31 connects to the middle of the bottom of the fusible element 29, and an end of the central electrode 31 connects to the fourth electrode 44. The central electrode 31 is separated from the first heating element 33 by an insulating layer 32 disposed therebetween. An absorbent element 48 is disposed above the middle of the fusible element 29 to accumulate and absorb molten fusible element 29 to enhance blowing efficiency. In this embodiment, the second planar substrate 23 is disposed above the first planar substrate 36 and has a smaller area compared to the first planar substrate 36. Nevertheless, the area relation between the first planar substrate 36 and the second planar substrate 23 is not limited in the present application. The lower surface of the second planar substrate 23 forms a second surface 39 facing the first surface 38. A fifth electrode 24 and a sixth electrode 47 are printed on the second surface 39. Two ends of the second heating element 25 connect to the fifth electrode 24 and the sixth electrode 47. The fifth electrode 24 and the sixth electrode 47 electrically connect to the lower third electrode 34 and the fourth electrode 44 through an electrode FIG. 27 and conductive posts 28, so as to form a heater 50 in which a first heating element 33 and a second heating element 25 are in parallel connection. The fusible element 29 is adjacent to the first heating element 33 and the second heating element 25 to absorb the heat generated therefrom and be melted. An insulating layer 26 is disposed below the second heating element 25 to separate the second heating element 25 from the fusible element 29. An upper surface of the second planar substrate 23 may be provided with a metal heat dissipation layer 22 to enhance heat dissipation and avoid cracks of the second planar substrate 23. An insulating layer 21 may be formed on the metal heat dissipation layer 22 for insulation and protection.

Figure 5:
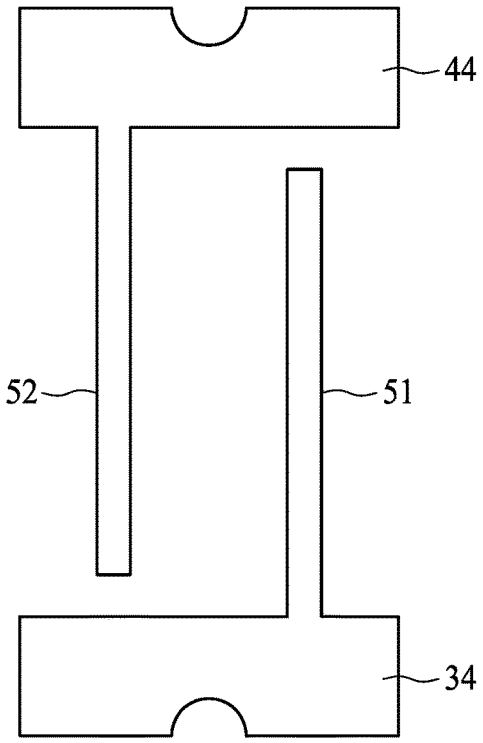
FIG. 5 shows heating electrodes of the protection device in accordance with an embodiment of the present application.

In the above embodiment, the first heating element 33 and the second heating element 25 connect to electrodes at elongated ends. However, electrodes may connect to lateral sides of the first heating element 33 and the second heating element 25 to obtain different resistances of the heating elements 33 and 25 if needed. FIG. 5 shows a third electrode 34 and a fourth electrode 44 in accordance with another embodiment of the present application. The third and fourth electrodes 34 and 44 comprise extending portions 51 and 52, respectively, to connect to two lateral sides of the first heating element 33.

In an embodiment, the components such as the first heating element 33 and the fusible element 29 are sequentially formed on the first surface 38 of the first planar substrate 36 (base substrate), whereas other components such as the second heating element 25 are sequentially formed on the second surface 39 of the second planar substrate 23 (upper substrate). When components are individually fabricated on the first planar substrate 36 and the second planar substrate 23 as bases, the first surface 38 and the second surface 39 face upward to allow the first heating element 33 and the second heating element 25 to be printed thereon. Accordingly, the first heating element 33 is a printing member on the first surface 38, and the second heating element 25 is a printing member on the second surface 39.

Afterwards, the second planar substrate 23 is turned over to combine with the first planar surface 36 to form the protection device 20. The first planar substrate 36 and the second planar substrate 23 serve as bases, allowing primary components to be made by printing. As a result, the thicknesses of the heating elements and electrodes can be decreased for miniaturization. A cap of a traditional protection device is not a planar substrate, and therefore it does not allow the components to be printed thereon. Therefore, the manufacturing efficiency is not good, and the protection device is not easily miniaturized. Moreover, the manufacturing is conducted on the base substrate and the upper substrate individually and can be conducted simultaneously to increase throughput. If defective semi-manufactured products are found before combination, they can be screened out to increase production yield.

In an embodiment, the first planar substrate 36 and the second planar substrate 23 may be a rectangular insulating substrate including aluminum oxide, aluminum nitride, zirconium oxide and/or heat-resistant glass. The first electrode 35, the second electrode 45, the third electrode 34, the fourth electrode 44, the fifth electrode 24 and/or the sixth electrode 47 may comprise silver, gold, copper, tin, nickel or other conductive metals, and the thickness is approximately 0.005-1 mm. In addition to making the electrodes by printing, they may be alternatively made of metal sheets for high-voltage applications. The fusible element 29 may comprise low-melting metal or its alloy, e.g., Sn—Pb—Ag, Sn—Ag, Sn—Sb, Sn—Zn, Zn—Al, Sn—Ag—Cu, Sn. The length and width of the fusible element 29 vary according to the designated current flowing therethrough, but they should not exceed the lengths and widths of the first planar substrate 36 and the second planar substrate 23. The thickness of the fusible element 29 is 0.005-1 mm, preferably 0.01-0.5 mm. A thicker fusible element 29 can be used for the applications of a large current such as 30-100A. The first and second heating elements 33 and 25 may comprise ruthenium oxide ($RuO_2$) with additives of silver (Ag), palladium (Pd), and/or platinum (Pt). The insulating layers 32 and 26 between the first and second heating elements 33, 25 and the fusible element 29 may contain glass, epoxy, aluminum oxide, silicone or glaze. The absorbent element 48 may be made by printing or electroplating. The composition of the absorbent element 48 may comprise silver, gold, copper, nickel, tin, lead, antimony, or alloy thereof, and may be in the form of a single layer or multiple layers.

Figure 6:
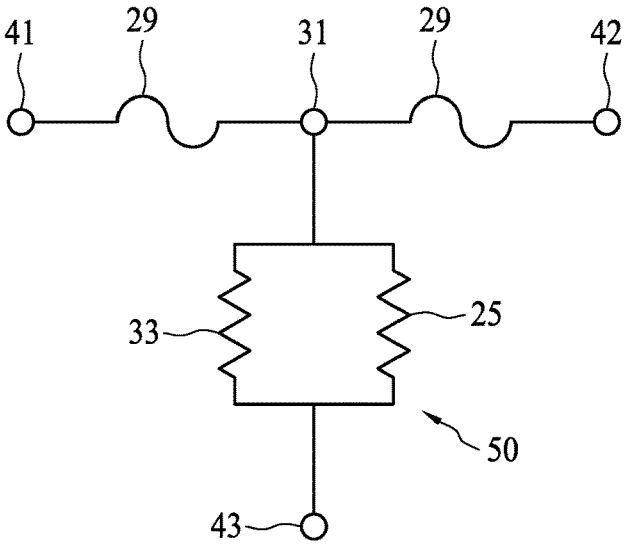
FIG. 6 shows an equivalent circuit diagram of the protection device in accordance with an embodiment of the present application.

An equivalent circuit diagram of the protection device 20 of this embodiment is depicted in FIG. 6. The first electrode terminal 41 connects to a terminal of an apparatus to be protected such as a secondary battery or a motor, whereas the second electrode terminal 42 connects to a terminal of a charger or the like. A heater 50 comprises the first heating element 33 and the second heating element 25 in parallel connection. One end of the heater 50 connects to the central electrode 31 and another end connects to the third terminal 43. In terms of the circuit of the protection device 20, the fusible element 29 comprises two fuses in serial connection, and the heater 50 comprises the first and second heating elements 33 and 25 denoted by resistor symbols in parallel connection. In the event of over-current, current flows through the fusible element 29 which is therefore blown to provide over-current protection. When over-voltage or over-temperature occurs, current flows through the heater 50. The heater 50 heats up and transfers heat to the fusible element 29, thereby blowing the fusible element 29 to provide over-voltage and over-temperature protection.

Table 1 shows embodiments E1-E4 in which the protection device 20 includes the first and second heating elements 33 and 25 with different resistances. In each of E1-E4, the resistance of the first heating element 33 is 0.95Ω, and the resistance of the second heating element 25 is at least twice that of the first heating element 33. The resistances of the second heating elements 25 in E1-E4 are 3.7Ω, 6.5Ω, 8.5Ω and 11.5Ω, respectively. The protection devices 20 are of a form factor 3820. Because the first heating element 33 and the second heating element 25 are in parallel connection, the resistances of the heaters 50 in E1-E4 are 0.77Ω, 0.82Ω, 0.85Ω and 0.87Ω, respectively, upon calculation.

TABLE 1

| | First heating element (Ω) | Second heating element (Ω) | Heater (Ω) |
|---|---|---|---|
| E1 | 0.95 | 3.7 | 0.77 |
| E2 | 0.95 | 6.5 | 0.82 |
| E3 | 0.95 | 8.5 | 0.85 |
| E4 | 0.95 | 11.5 | 0.87 |

Figure 7:
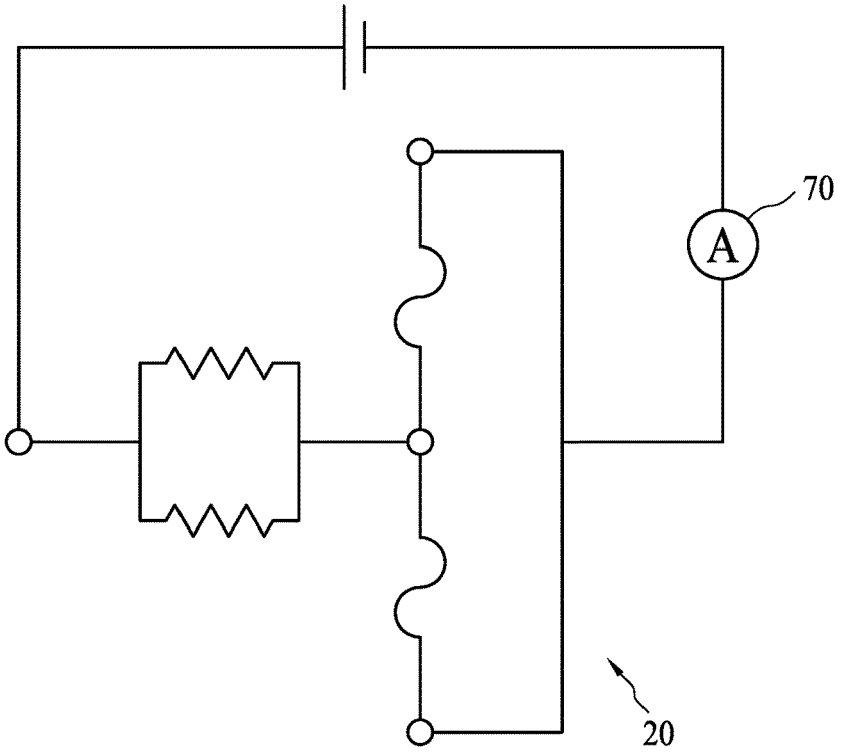
FIG. 7 shows a testing circuit diagram of the protection device in accordance with an embodiment of the present application.
Figure 8:
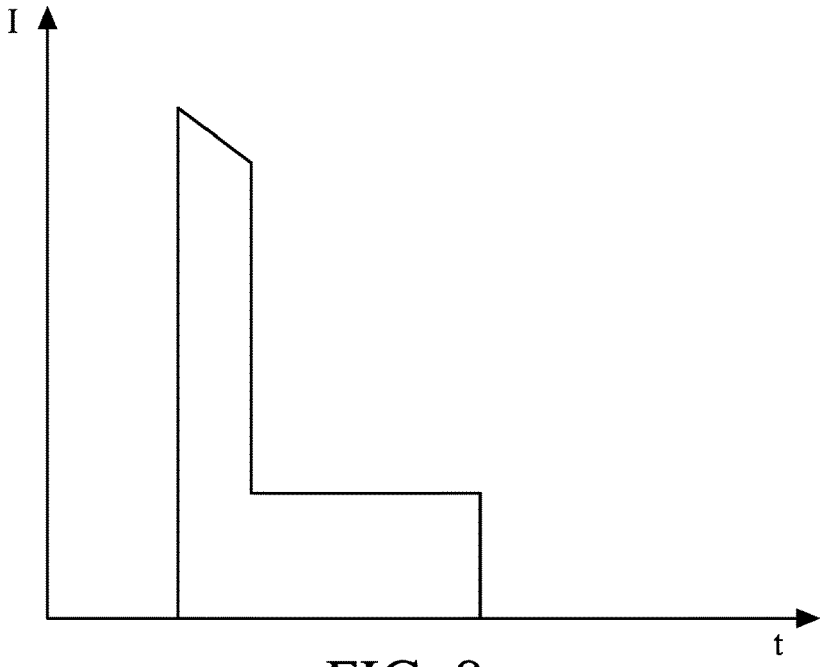
FIG. 8 shows a current vs. time diagram of the protection device in accordance with an embodiment of the present application.

The protection devices of E1-E4 are subjected to 5V, 10V, 15V and 21V testing according to the circuit shown in FIG. 7, and the results are shown in Table 2. A current meter 70 is connected in series in the circuit to measure currents. In E1, the fuses of the fusible element 29 are blown in 5V, 10V and 15V testing. In 5V testing, a current of 4.6 A is detected. Because the first and second heating elements 33 and 25 have a large resistance difference, most current flows through the first heating element 33 of a less resistance. Therefore, the first heating element 33 serves as a primary heat source, and the current flowing through the second heating element 25 can be ignored. The power of the first heating element 33 is 20 W upon calculation based on current, and the two fuses of the fusible element 29 can be blown normally. In 10V testing, the two fuses of the fusible element 29 can be blown. In 15V testing, the two fuses of the fusible element 29 are blown; however, flaws or cracks occur in the upper substrate, i.e., the second planar substrate 23. In 21V testing, the first heating element 33 can withstand such high voltage at the beginning A power of 320 W can be calculated upon the current detected in the circuit. The first heating element 33 is not able to withstand such high power after a certain period of time and then is blown to make the circuit open, and as a consequence the current is switch to the second heating element 25 to generate a power of 75 W. The heater 50 is circuit open due to cracks in the overheated upper substrate, and therefore the heater 50 no longer heats up to blow the fusible element 29. In E2, the second heating element 25 has a larger resistance of 6.5Ω, and the two fuses of the fusible element 29 are blown in 5V, 10V, 15V and 21V tests. During 15V and 21V testing, current flows through the first heating element 33 to generate powers of 194 W and 350 W, respectively, and then the first heating element 33 is blown to cause current to flow through the second heating element 25 to generate powers of 30 W and 60 W, respectively. However, flaws occur in the upper substrate during the 21V testing. In E3 the second heating element 25 has a resistance of 8.5Ω, and the two fuses of the fusible element 29 are blown in 5V, 10V, 15V and 21V tests. During 15V and 21V testing, current flows through the first heating element 33 to generate powers of 180 W and 320 W, respectively, and then the first heating element 33 is blown to cause current to switch to the second heating element 25 to generate powers of 21 W and 43 W. However, flaws occur in the upper substrate during the 21V testing. In E4 the second heating element 25 has a resistance of 11.5Ω, and the two fuses of the fusible element 29 are blown in 5V, 10V, 15V and 21V tests and there are no flaws in the upper substrate. Similarly, in the testing of 15V and 21V, current flows through the first heating element 33 first, and then switches to the second heating element 25 when the first heating element 33 is blown. Upon the testing results, the fusible element 29 is not blown in 21V testing when the resistance of the second heating element 25 in the upper substrate is 3.7Ω. When the resistance of the second heating element 25 increases to 6-12Ω, the fusible element 29 can be blown normally in the test of 21V.

element 25 after the first heating element 33 is blown. The relationship of the current vs. time is shown in FIG. 8. Because of a smaller resistance, the first heating element 33 has a larger current flowing therethrough at the beginning. When the first heating element 33 cannot withstand the power and is blown, the current switches to the second heating element 25 in parallel connection with the first heating element 33. Because of a larger resistance, the second heating element 25 has a smaller current flowing therethrough. In FIG. 8, the moment of rapid current decrease is the time at which the first heating element 33 is blown and the second heating element 25 is enabled. The second heating element 25 has a much larger resistance than the first heating element 33, so that most current goes through the first heating element 33 at a low voltage below a predetermined voltage. In an embodiment, the resistance of the second heating element 25 is at least twice that of the first heating element 33, for example, 2-fold, 2.5-fold, 3-fold, 3.5-fold, 4-fold, and less than 12-fold. A large resistance difference indicates a relatively high resistance of the second heating element 25, it may increase the melting time after the second heating element 25 is activated.

Figure 9:
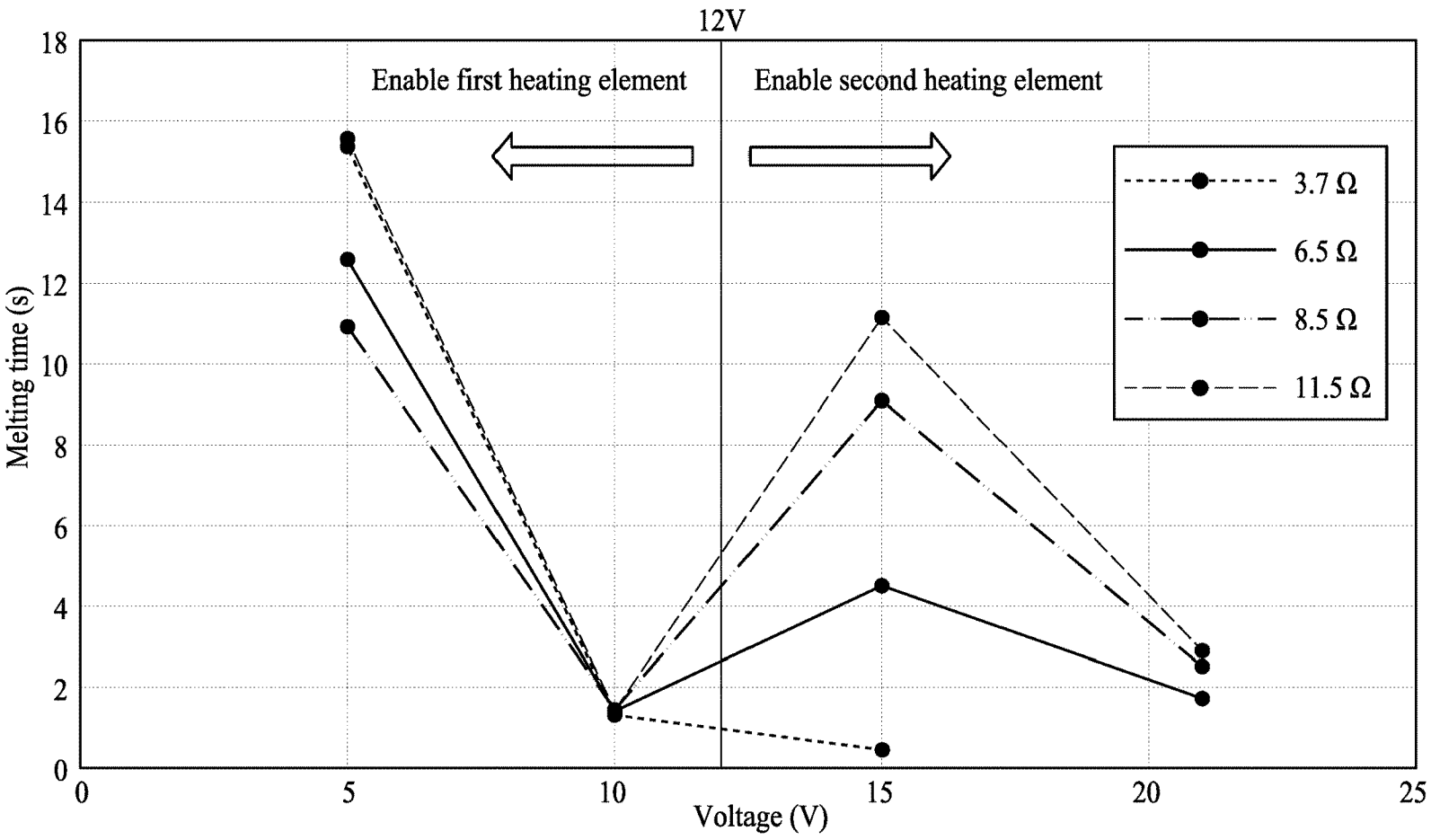
FIG. 9 shows a melting time vs. voltage diagram of the protection device in accordance with an embodiment of the present application.

The melting times of E1-E4 are listed in Table 2, and the melting time vs. voltage diagram is shown in FIG. 9 in which the polylines corresponding to the second heating elements 25 of different resistances. At 5V and 10V, below a predetermined voltage 12V, most current flows through the first heating element 33 on the base substrate and the current goes through the second heating element 25 on the upper substrate can be ignored. In compared to 5V, the melting time can be significantly decreased at 10V. At 5V, the second heating element 25 of a higher resistance induces more current going through the first heating element 33 as a heat source, and therefore the melting time is shorter. At the voltages 15V and 21V, higher than the predetermined voltage 12V, the first heating element 33 is blown and does not allow current to flow therethrough, and the current switches from the first heating element 33 to the second heating element 25. Likewise, in contrast to 15V, the melting time is shorter for 21V. At 21V, the second heating element 25 of a higher resistance induces less current flowing therethrough as a heat source, and therefore the melting time is longer. In

TABLE 2

| Voltage | 5 V | 10 V | 15 V | 21 V |
|---|---|---|---|---|
| E1 | 20 W<br>Two fuses blown<br>Melting time:<br>15.7 sec | 84 W<br>Two fuses blown<br>Melting time:<br>1.3 sec | 185 W<br>Two fuses blown<br>(Upper substrate crack)<br>Melting time:<br>0.3 sec | 320 W/75 W<br>No fuse blown<br>(Upper substrate crack) |
| E2 | 23 W<br>Two fuses blown<br>Melting time:<br>12.7 sec | 90 W<br>Two fuses blown<br>Melting time<br>1.3 sec | 194 W/30 W<br>Two fuses blown<br>Melting time:<br>4.3 sec | 350 W/60 W<br>Two fuses blown<br>(Upper substrate crack)<br>Melting time:<br>1.9 sec |
| E3 | 21 W<br>Two fuses blown<br>Melting time:<br>10.8 sec | 86 W<br>Two fuses blown<br>Melting time:<br>1.3 sec | 180 W/21 W<br>Two fuses blown<br>Melting time:<br>9.2 sec | 320 W/43 W<br>Two fuses blown<br>(Upper substrate crack)<br>Melting time:<br>2.5 sec |
| E4 | 20 W<br>Two fuses blown<br>Melting time:<br>15.8 sec | 82 W<br>Two fuses blown<br>Melting time:<br>1.3 sec | 188 W/18 W<br>Two fuses blown<br>Melting time:<br>11.1 sec | 310 W/37 W<br>Two fuses blown<br>Melting time:<br>2.9 sec |

In E1-E4, when the voltage exceeds a predetermined voltage, e.g., 12V, the current goes through the first heating element 33 first and then switches to the second heating view of E1-E4, the first heating element 33 is activated as a heat source at voltages below 12V to heat the fusible element 29, whereas the second heating element 25 is activated as a heat source at voltages greater than 12V. As a result, the protection device 20 automatically selects the first heating element 33 or the second heating element 25 to withstand a voltage up to 21V, thereby increasing voltage endurance range significantly.

Table 3 shows the protection devices 20 including the first and second heating elements 33 and 25 with different resistances in accordance with the embodiments E5-E8 in which the resistances of the first heating elements 33 are 1.05Ω, 1.4Ω, 1.4Ω and 1.8Ω, and the resistances of the second heating elements 25 have higher resistances of 4.4Ω, 5.8Ω, 7.5Ω and 15.5Ω, respectively. The devices of E5-E8 are of a form factor 2213 which is smaller than that of E1-E4. Because the first and second heating elements 33 and 25 are in parallel connection, the resistances of the heaters 50 of E5-E8 are calculated to be 0.85Ω, 1.11Ω, 1.22Ω and 1.64Ω, respectively.

TABLE 3

| | First heating element (Ω) | Second heating element (Ω) | Heater (Ω) |
|---|---|---|---|
| E5 | 1.05 | 4.4 | 0.85 |
| E6 | 1.4 | 5.8 | 1.11 |
| E7 | 1.4 | 7.5 | 1.22 |
| E8 | 1.8 | 15.5 | 1.64 |

The protection devices of E5-E8 are subjected to 5V, 10V and 15V testing according to the circuit in FIG. 7, and the results are shown in Table 4. In E5, at 5V, because the first and second heating elements 33 and 25 have a large resistance difference, most current flows through the first heating element 33 of a less resistance, and the current flowing through the second heating element 25 can be disregarded. A current of 4.2 A is detected, and accordingly the power of the first heating element 33 is calculated to be 20 W. The two fuses of the fusible element 29 can be blown normally. In 10V testing, the first heating element 33 can withstand the power at the beginning, and a power of 78 W can be calculated according to detected current. After that, the first heating element 33 cannot withstand the power and is blown. Current is switched to the second heating element 25 and generates a power of 18 W. Only one fuse of the fusible element 29 is blown, and the upper substrate has cracks. In 15V testing, overheat causes cracks in the upper substrate to block current flowing through the heater 50. Therefore, the heater 50 cannot blow the fusible element 29. E6 has higher resistances 1.4Ω and 5.8Ω of the first and second heating elements 33 and 25. In 5V testing, the two fuses of the fusible element 29 can be blown. In 10V and 15V testing, only one fuse of the fusible element 29 is blown and the upper substrate is cracked. In E7, the first heating element 33 has a resistance of 1.4Ω and the second heating element 25 has a resistance of 7.5Ω. In 5V, 10V and 15V testing, the two fuses of the fusible element 29 can be blown normally, however there are cracks on the upper substrate in the 15V testing. In E5-E7, the predetermined voltage is between 5V and 10V, such as 8V. When the voltage is 10V, which is larger than the predetermined voltage 8V, the first heating element 33 is blown and the second heating element 25 is activated. In E8, the first heating element 33 has a higher resistance of 1.8Ω, and the second heating element 25 has a higher resistance of 15.5Ω. In 5V and 10V testing, current flowing through the first heating element 33 to heat and blow the two fuses of the fusible element 29. At 15V, the first heating element 33 is blown and current flows through the second heating element 25 to blow the two fuses of the fusible element 29 without upper substrate cracks. The predetermined voltage of E8 is 10-15V. The first and second heating elements 33 and 25 of higher resistances usually have higher predetermined voltages and can withstand up to 15V and blow the two fuses of the fusible element 29. The increase of the resistance of the second heating element 25 can reduce the likelihood of cracks on the upper substrate (second planar substrate). For example, the resistance of the second heating element 25 is more than five times that of the first heating element 33.

TABLE 4

| Voltage | 5 V | 10 V | 15 V |
|---|---|---|---|
| E5 | 20 W Two fuses blown | 78 W/18 W One fuse blown (Upper substrate crack) | 181 W/42 W No fuse blown (Upper substrate crack) |
| E6 | 18 W Two fuses blown | 70 W/15 W One fuse blown (Upper substrate crack) | 150 W/35 W One fuse blown (Upper substrate crack) |
| E7 | 15 W Two fuses blown | 64 W/12 W Two fuses blown | 144 W/28 W Two fuses blown (Upper substrate crack) |
| E8 | 12 W Two fuses blown | 48 W Two fuses blown | 110 W/14 W Two fuses blown |

Figure 10:
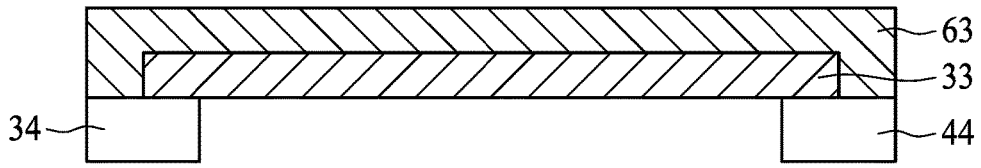
FIGS. 10 and 11 show embodiments of the protection device of the present application in which a heater further comprises a heating element.
Figure 11:
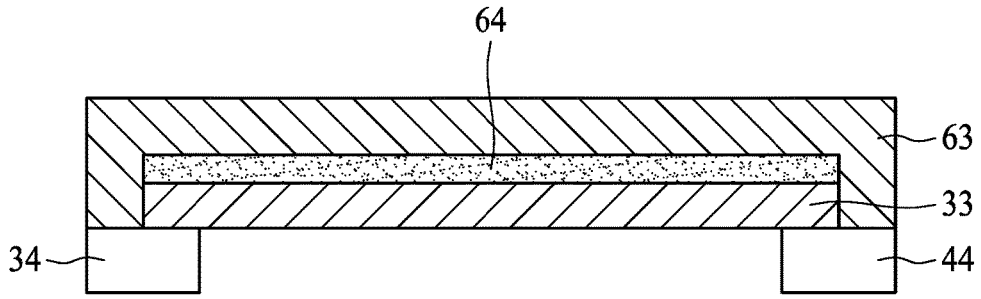
Figure 12:
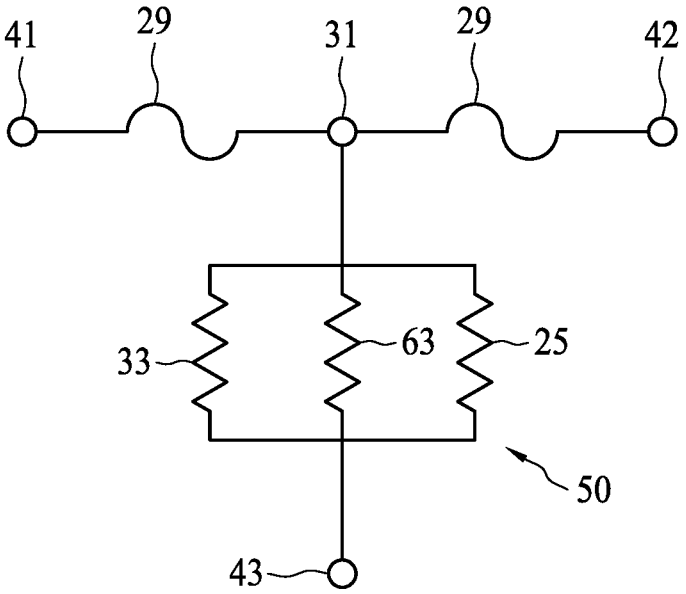
FIG. 12 shows a circuit diagram of the protection devices of FIGS. 10 and 11.

In the embodiments shown in FIGS. 10 and 11, a third heating element 63 is further formed on and in parallel connection to the first heating element 33. The third heating element 63 may be formed on the surface of the first heating element 33, or an insulating layer 64 is laminated therebetween. The third heating element 63 connects to the third electrode 34 and the fourth electrode 44 at two ends. The resistance of the third heating element 63 differs from that of the first heating element 33, and is preferably more than two times the resistance of the first heating element 33. For example, the resistance of the first heating element 33 is 1), the resistance of the second heating element 25 is 10Ω, and the resistance of the third heating element 63 is 4Ω. The resistance of the heater 50 can be adjusted by the third heating element 63 of a different resistance. The equivalent circuit diagram of that adding the third heating element 63 is shown in FIG. 12. The third heating element 63 is not limited to be disposed on the first planar substrate 36, it can be disposed on the second planar substrate 23 instead. A fourth heating element may be further added and connect to the other heating elements in parallel. In practice, the first heating element and the second heating element are not limited to be disposed on different planar substrates. Instead, they can be connected in parallel and disposed on the same first planar substrate.

Figure 13:
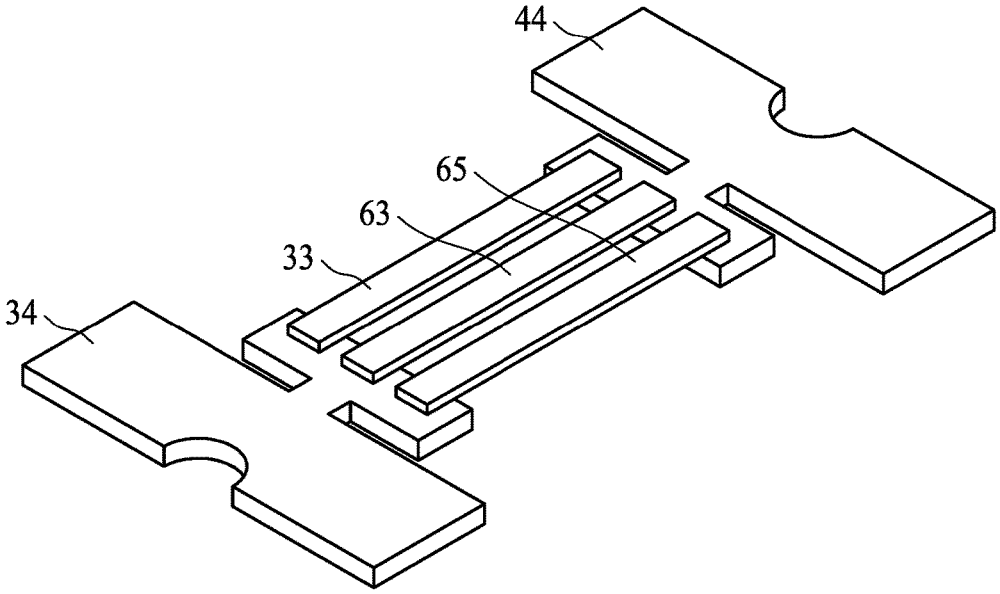
FIG. 13 shows a heater of the protection device in accordance with an embodiment of the present application.

The third heating element 63 in FIG. 10 or 11 is formed by stacking and may increase height of the protection device. Alternatively, the other heating elements may be formed on the same first planar substrate with the first heating element 33 to obtain a lower height. In FIG. 13, in addition to the first heating element 33 connecting to the third electrode 34 and the fourth electrode 44, the third heating element 63 and the fourth heating element 65 further connect to the electrodes 34 and 44. As such, the first, third and fourth heating elements 33, 63 and 65 are in parallel connection. The resistance of the first, third and fourth heating elements 33, 63 and 65 can be adjusted by varying their length, width, shape and material as desired to meet heating requirements. This heating design may be applied to the upper planar substrate. Accordingly, the first heating element 33, the third heating element 63 and fourth heating element 65 can be printed on the same plane without height increase concern.

In sum, the protection device of the present application uses at least two heating elements in parallel connection to generate heat to blow the fusible element in the event of over-voltage. The resistances of the two heating elements differ by at least two times. Accordingly, the heating element of a low resistance serves as a heat source to blow the fusible element at low voltages. When the voltage exceeds a predetermined value, the heating element of a low resistance cannot withstand the corresponding power and therefore is blown. Current is switched to the heating element of a high resistance which replaces the one of low of resistance as a heat source to blow the fusible element. In other words, the low-resistance heating element serves as the source to heat and blow the fusible element when the voltage is below the predetermined value, e.g., at low voltages. The high-resistance heating element is automatically switched to be the heat source to blow the fusible element when the voltage exceeds the predetermined value, i.e., at high voltages. As such, the voltage endurance is improved, and the voltage application range is enlarged.

The above-described embodiments of the present invention are intended to be illustrative only. Numerous alternative embodiments may be devised by persons skilled in the art without departing from the scope of the following claims.

What is claimed is:

1. A protection device, comprising:

a first planar substrate comprising a first surface;

a second planar substrate comprising a second surface facing the first surface;

a heater comprising a first heating element and a second heating element in parallel connection, the first heating element being disposed on the first surface;

a fusible element disposed on the first surface and adjacent to the first heating element and the second heating element to absorb heat generated from at least one of the first and second heating elements and thereby be blown;

wherein a resistance of the second heating element is at least twice that of the first heating element;

wherein the first heating element is blown when a voltage applied to the protection device exceeds a predetermined voltage;

wherein the first heating element heats the fusible element when the voltage is less than the predetermined voltage and the second heating element heats the fusible element when the voltage exceeds the predetermined voltage.

2. The protection device of claim 1, wherein the second heating element is disposed on the second surface and the fusible element is disposed between the first heating element and the second heating element.

3. The protection device of claim 1, wherein the fusible element has two ends connecting to a first electrode and a second electrode, the first heating element has two ends connecting to a third electrode and a fourth electrode, and the second heating element has two ends connecting to a fifth electrode and a sixth electrode.

4. The protection device of claim 3, wherein the third electrode and the fifth electrode are electrically connected through conductive posts, and the fourth electrode and the sixth electrode are electrically connected through other conductive posts.

5. The protection device of claim 1, wherein the fusible element connects to a first terminal and a second terminal at two ends, a middle of the fusible element connects to a central electrode, and the heater electrically connects to the central electrode and a third terminal at two ends.

6. The protection device of claim 1, further comprising an absorbent element disposed above a middle of the fusible element to accumulate molten fusible element.

7. The protection device of claim 1, wherein the first heating element is printed on the first surface, and the second heating element is printed on the second surface.

8. The protection device of claim 1, further comprising a third heating element in parallel connection to the first and second heating elements.

9. The protection device of claim 8, wherein the third heating element and the first heating element are formed on a same plane.

10. The protection device of claim 1, wherein the resistance of the second heating element does not exceed 12 times that of the first heating element.

* * * * *